US009097221B2

(12) United States Patent
Kuraoka

(10) Patent No.: US 9,097,221 B2
(45) Date of Patent: Aug. 4, 2015

(54) INTAKE APPARATUS

(75) Inventor: Shinji Kuraoka, Toyota (JP)

(73) Assignee: KOJIMA PRESS INDUSTRY CO., LTD., Toyota-Shi (JP)

( * ) Notice: Subject to any disclaimer, the term of this patent is extended or adjusted under 35 U.S.C. 154(b) by 0 days.

(21) Appl. No.: 14/234,761

(22) PCT Filed: Jul. 18, 2012

(86) PCT No.: PCT/JP2012/068148

§ 371 (c)(1),
(2), (4) Date: Jan. 24, 2014

(87) PCT Pub. No.: WO2013/015161

PCT Pub. Date: Jan. 31, 2013

(65) Prior Publication Data

US 2014/0190439 A1 Jul. 10, 2014

(30) Foreign Application Priority Data

Jul. 25, 2011 (JP) ..... 2011-161652

(51) Int. Cl.
*F02M 35/10* (2006.01)
*F02M 35/12* (2006.01)
*F01M 13/02* (2006.01)

(52) U.S. Cl.
CPC ..... *F02M 35/1255* (2013.01); *F01M 13/021* (2013.01)

(58) Field of Classification Search
CPC ..... F02M 35/1255; F02M 35/10222
USPC ..... 123/184.22, 41.86, 184.21–184.61, 123/525, 572, 573, 574
See application file for complete search history.

(56) References Cited

U.S. PATENT DOCUMENTS

| | | | | |
|---|---|---|---|---|
| 6,273,074 | B1 * | 8/2001 | Kawamata | 123/572 |
| 7,950,363 | B2 * | 5/2011 | Currie et al. | 123/184.57 |
| 2003/0136386 | A1 * | 7/2003 | Itakura et al. | 123/520 |
| 2010/0065005 | A1 * | 3/2010 | Currie et al. | 123/184.57 |
| 2010/0071676 | A1 * | 3/2010 | Arvan | 123/573 |
| 2010/0154736 | A1 * | 6/2010 | Ohzono | 123/198 E |

FOREIGN PATENT DOCUMENTS

| | | | |
|---|---|---|---|
| JP | 05-30411 | U | 4/1993 |
| JP | 2000-018109 | A | 1/2000 |
| JP | 2003-214263 | A | 7/2003 |
| JP | 2008215152 | A * | 9/2008 |

* cited by examiner

*Primary Examiner* — Lindsey Low
*Assistant Examiner* — Long T Tran
(74) *Attorney, Agent, or Firm* — Kenyon & Kenyon LLP

(57) ABSTRACT

An intake apparatus includes an intake pipe, a resonator and a blowby gas recirculation pipe. The resonator includes a volume portion having a volume chamber therein and a connecting pipe connecting the volume portion and the intake pipe and having a connecting passage connecting the volume chambera and the intake passage. The blowby gas recirculation pipe includes an internal passage therein. The blowby gas recirculation pipe is connected to an axially midway portion of the connecting pipe, and an exit of the internal passage is connected to the connecting passage of the connecting pipe.

5 Claims, 4 Drawing Sheets

INTAKE APPARATUS

CROSS-REFERENCE TO RELATED APPLICATIONS

This is a national phase application based on the PCT International Patent Application No. PCT/JP2012/068148 filed on Jul. 18, 2012, claiming priority to Japanese Patent Application No. 2011-161652 filed Jul. 25, 2011, the entire contents of both of which are incorporated herein by reference.

TECHNICAL FIELD

The present invention relates to an intake apparatus of a vehicle.

BACKGROUND

Japanese Patent Publication 2003-214263 discloses the following (i) and (ii) intake apparatuses:

(i) An intake apparatus 1*a* illustrated in FIG. 3 where a blowby gas recirculation pipe 4 is connected to a volume portion 3*a* of a resonator 3. In FIG. 3, reference numerals or alphabets 2, 2*a*, 2*b* and E illustrate an intake pipe, an intake passage of the intake pipe, an air cleaner and an engine, respectively.

(ii) An intake apparatus 1*b* illustrated in FIG. 4 where a blowby gas recirculation pipe 4 is connected directly to the intake pipe 2 without via the resonator 3. In FIG. 4, reference numerals or alphabets 2*a*, 2*b* and E illustrate the intake passage of the intake pipe, the air cleaner and the engine.

However, there are the following problems with the conventional intake apparatuses: With the intake apparatus of (i) above (the intake apparatus of FIG. 3), oil (oil mist) and water (steam) that have flowed through the blowby gas recirculation pipe 4 may stay stagnant in the volume portion 3*a* of the resonator 3 without flowing into the intake passage 2*a* of the intake pipe 2. With the intake apparatus of (ii) above (the intake apparatus of FIG. 4), two apertures, including an aperture 2*c* for the resonator 3 and an aperture 2*d* for the blowby gas recirculation pipe 4, have to be provided at the intake pipe 2, which causes a disadvantage from the viewpoint of cost.

RELATED ART DOCUMENT

Patent Document

Patent Document 1: Patent Publication JP 2003-214263

BRIEF SUMMARY

Problems to be Solved

An object of the present invention is to provide an intake apparatus which can achieve at least one of (i) preventing oil and water from staying stagnant in a resonator and (ii) decreasing a cost of the apparatus.

Means for Solving the Problems

The present invention for achieving the above object is as follows:

(1) An intake apparatus comprising an intake pipe for a vehicle, a resonator and a blowby gas recirculation pipe, wherein the intake pipe includes an intake passage therein, wherein the resonator includes a volume portion and a connecting pipe connecting the volume portion and the intake pipe, the volume portion including a volume chamber therein, the connecting pipe including a connecting passage therein and connecting the volume chamber of the volume portion and the intake passage of the intake pipe, wherein the blowby gas recirculation pipe includes an internal passage therein, and wherein the blowby gas recirculation pipe is connected to the connecting pipe of the resonator at an axial and midway portion of the connecting pipe, and an exit of the internal passage of the blowby gas recirculation pipe is connected to the connecting passage of the connecting pipe of the resonator.

(2) An intake apparatus according to item (1) above, wherein the connecting pipe of the resonator includes an axis extending in an up-down direction over an entirety of the connecting pipe.

(3) An intake apparatus according to item (1) above, wherein the exit of the internal passage of the blowby gas recirculation pipe is located above an opening of the connecting passage of the connecting pipe of the resonator to the intake passage and is located below a connecting portion of the connecting passage of the connecting pipe of the resonator to the volume chamber.

(4) An intake apparatus according to item (1) above, wherein the exit of the internal passage of the blowby gas recirculation pipe opposes an inner wall surface of the connecting pipe of the resonator.

(5) An intake apparatus according to item (1) above, wherein an intake passage-side end of the connecting passage of the connecting pipe of the resonator has a larger diameter than portions of the connecting passage other than the intake passage-side end of the connecting passage.

Technical Advantages

According to the intake apparatus of item (1) above, since the blowby gas recirculation pipe is connected to the connecting pipe of the resonator at the axial and midway portion of the connecting pipe, and the exit of the internal passage of the blowby gas recirculation pipe is connected to the connecting passage of the connecting pipe of the resonator, the following technical advantages can be obtained:

Oil (oil mist) and water (steam) are more likely to enter the intake passage of the intake pipe than in a case where the blowby gas recirculation pipe is connected to the volume portion of the resonator. As a result, the oil and water having flowed through the blowby gas recirculation pipe are prevented from staying stagnant in the volume chamber of the resonator without flowing into the intake passage.

Further, an aperture provided at the intake pipe is only one unlike a case where the blowby gas recirculation pipe is connected directly to the intake pipe. As a result, a cost is decreased compared with a case where an aperture for the resonator and an aperture for the blowby gas recirculation, pipe (two apertures) are provided at the intake pipe.

According to the intake apparatus of item (2) above, since the connecting pipe of the resonator includes the axis extending in an up-down direction over an entirety of the connecting pipe, the following technical advantages can be obtained:

No concave shape exists at the connecting passage of the connecting pipe of the resonator. As a result, the oil and water that have flowed through the blowby gas recirculation pipe are prevented from staying in the connecting passage of the connecting pipe unlike the case where a concave shape exists at the connecting passage of the connecting pipe of the resonator.

According to the intake apparatus of item (3) above, since the exit of the internal passage of the blowby gas recirculation pipe is located above the opening of the connecting passage of the connecting pipe of the resonator to the intake passage and is located below the connecting portion of the connecting passage of the connecting pipe of the resonator to the volume chamber, the following technical advantages can be obtained:

The oil and water having flowed through the blowby gas recirculation pipe are likely to flow into the intake passage of the intake pipe and are unlikely to flow into the volume chamber of the resonator. As a result, the oil and water that have flowed through the blowby gas recirculation pipe are prevented from staying stagnant in the volume chamber of the resonator without flowing into the intake passage of the intake pipe.

According to the intake apparatus of item (4) above, since the exit of the internal passage of the blowby gas recirculation pipe opposes the inner wall surface of the connecting pipe of the resonator, the following technical advantages can be obtained:

The oil and water that have flowed through the blowby gas recirculation pipe collide with the inner wall surface of the connecting pipe of the resonator and change to liquid drops. As a result, the oil and water that have flowed through the blowby gas recirculation pipe are prevented from remaining in the form of mist and flowing into the volume chamber of the resonator.

According to the intake apparatus of item (5) above, since the intake passage-side end of the connecting passage of the connecting pipe of the resonator has a larger diameter than portions of the connecting passage other than the intake passage-side end of the connecting passage, the following technical advantages can be obtained:

Even at a cold time such as winter, water (steam) in the connecting passage of the connecting pipe of the resonator and/or water (steam) in the intake passage of the intake pipe are prevented from being frozen thereby blocking the opening of the connecting passage of the connecting pipe of the resonator to the intake passage.

DETAILED DESCRIPTION

Figure 1:
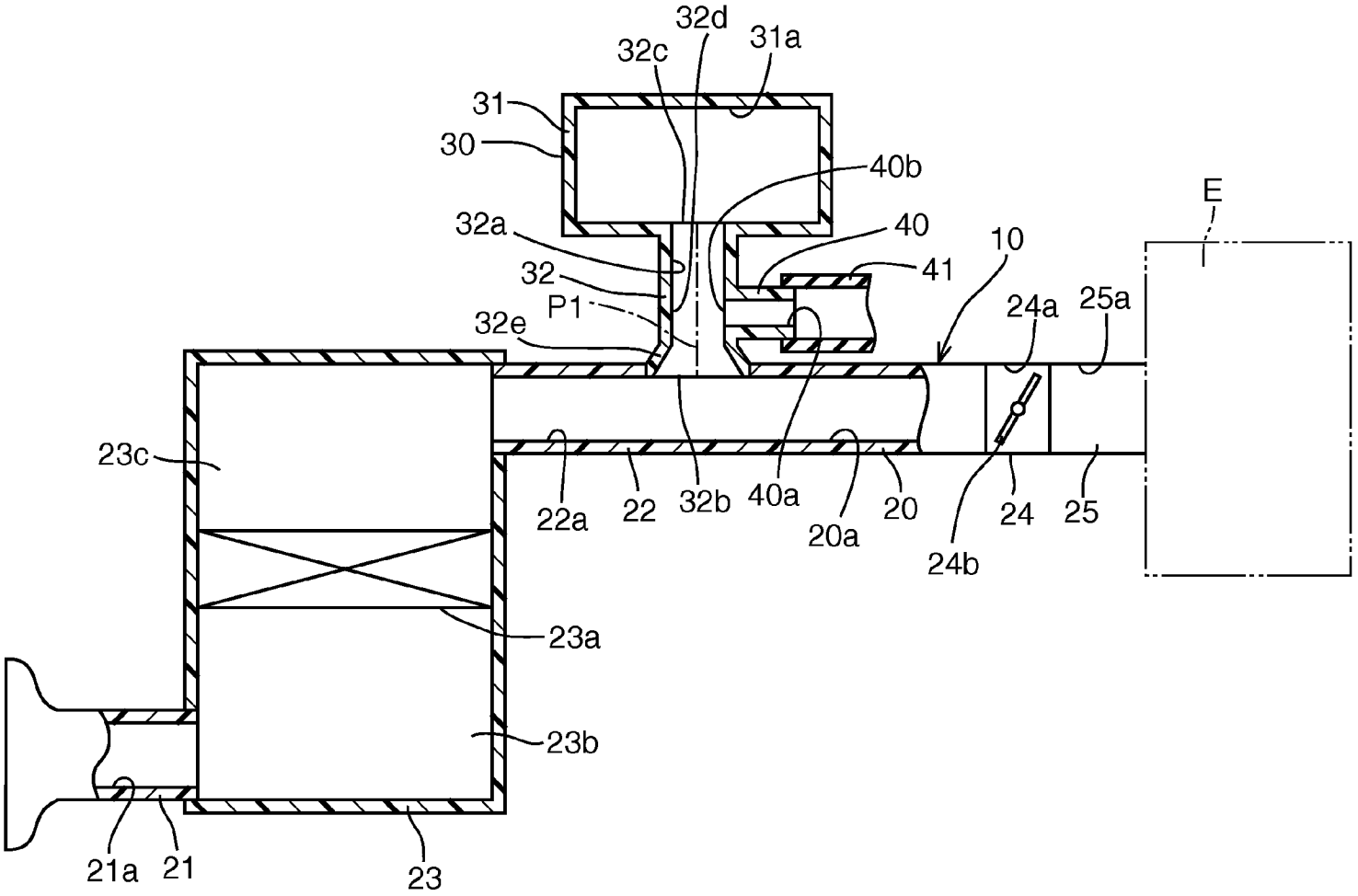
FIG. 1 is a system diagram of an engine intake system to which an intake apparatus according to certain embodiments of the present invention is provided, where a portion of an inlet, an air cleaner, a portion of an air cleaner hose, a resonator and a blowby gas recirculation pipe are shown in across section.
Figure 2:
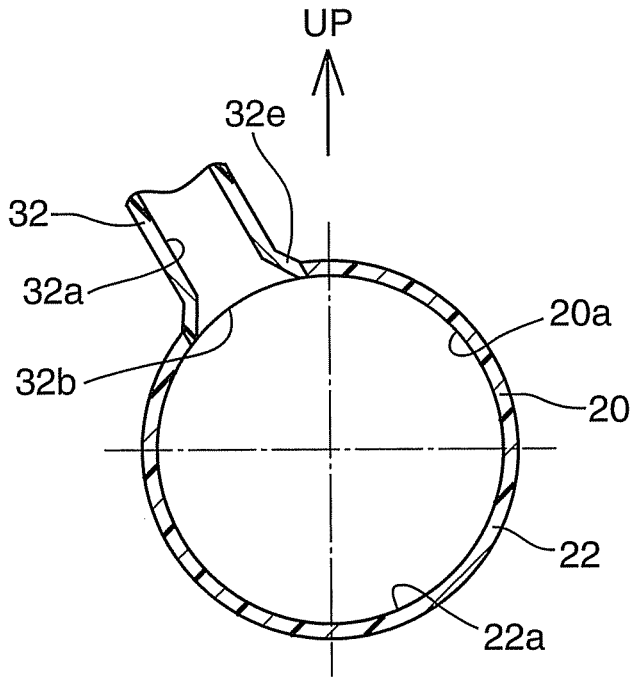
FIG. 2 is an enlarged, partial cross-sectional view of the intake apparatus according to certain embodiments of the present invention at a connecting pipe of the resonator.
Figure 3:
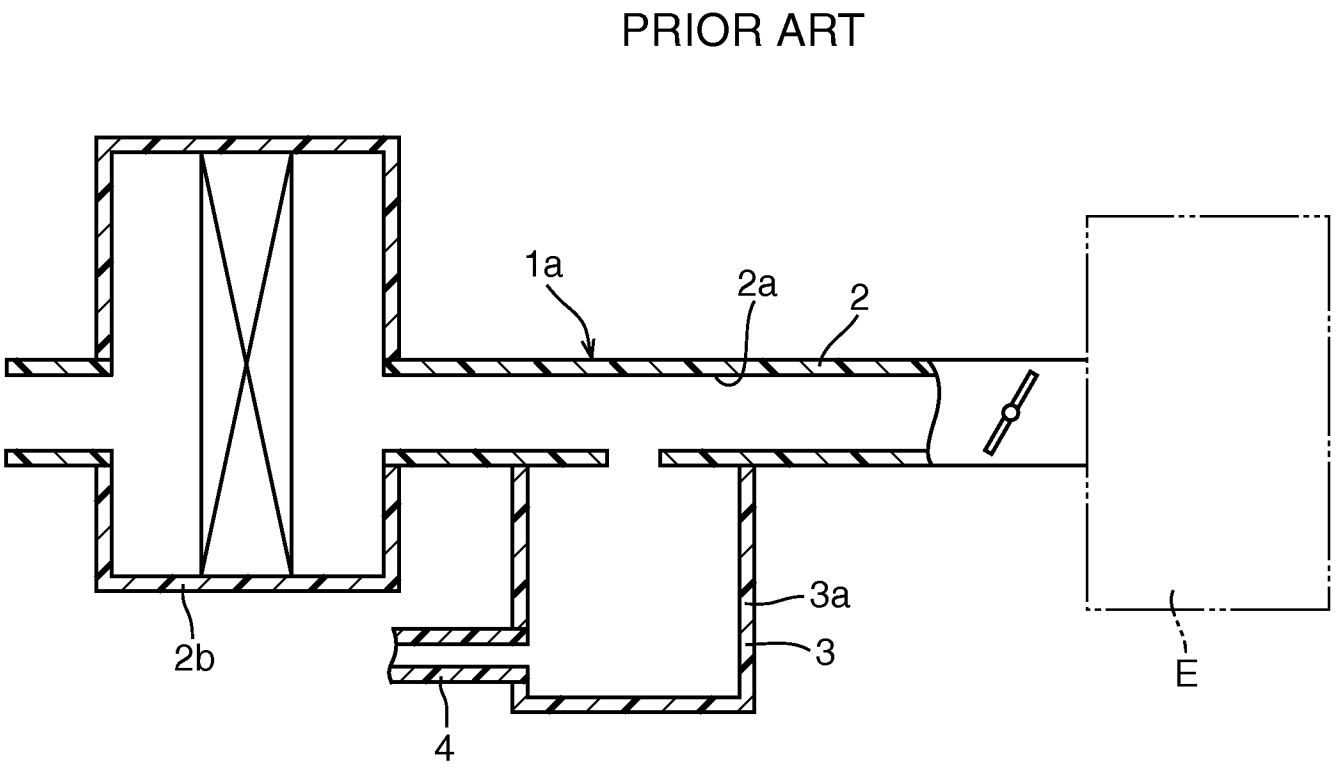
FIG. 3 is a prior art system diagram of an engine intake system to which a first conventional intake apparatus is provided, where a blowby gas recirculation pipe is connected to a volume portion of a resonator.
Figure 4:
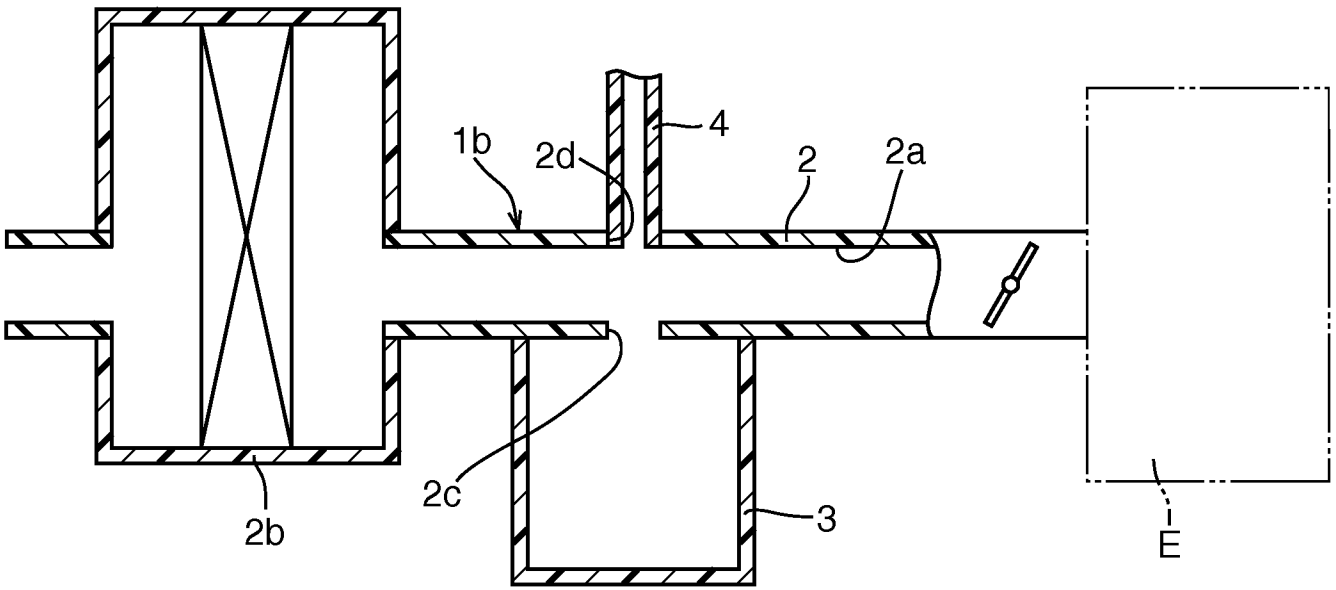
FIG. 4 is a prior art system diagram of an engine intake system to which a second conventional intake apparatus is provided, where a blowby gas recirculation pipe is connected directly to an intake pipe.

An intake apparatus according to certain embodiments of the present invention will be explained with reference to FIGS. 1 and 2. As illustrated in FIG. 1, an intake apparatus according to the embodiment of the present invention includes an intake pipe 20 of a vehicle, a resonator 30 and a blowby gas recirculation pipe 40.

The intake pipe 20 is a pipe for supplying air to an engine (an internal combustion engine) E of the vehicle. The intake pipe 20 includes an intake passage 20*a* therein. The intake pipe 20 includes an inlet (an inlet duct) 21, an air cleaner hose 22, a throttle body 24 and an intake manifold 25.

The inlet 21 is a duct extending upstreamly in an intake gas flow direction from the air cleaner 23. The air cleaner hose 22 is a hose extending downstreamly in the intake gas flow direction from the air cleaner 23. The air cleaner 23 is provided for removing foreign particles from air (intake gas) having flowed through the inlet 21 thereby preventing troubles from happening with the engine E. An air cleaner element 23*a* for removing foreign particles is provided to the air cleaner 23. An interior of the air cleaner 23 includes a dusty side 23*b* located upstream of the element 23*a* in the intake gas flow direction and a clean side 23*c* located downstream of the element 23*a* in the intake gas flow direction. The throttle body 24 connects a downstream-side end of the air cleaner hose 22 in the intake gas flow direction and an upstream-side end of the intake manifold 25 in the intake gas flow direction. A throttle valve 24*b* is disposed in the throttle body 24. The intake manifold 25 is provided between the throttle body 24 and the engine E in the intake gas flow direction.

The intake passage 20*a* includes an internal passage 21*a* of the inlet 21, an internal passage 22*a* of the air cleaner hose 22, an internal passage 24*a* of the throttle body 24 and an internal passage 25*a* of the intake manifold 25.

Air flows from an intake gas (air) inlet to the inlet 21. The air flows through the internal passage 21*a* of the inlet 21 to the dusty side 23*b* of the air cleaner 23 and then flows through the element 23*a* to the clean side 23*c* of the air cleaner 23. The air having flowed to the clean side 23*c* of the air cleaner 23 flows through the internal passage 22*a* of the air cleaner hose 22, the internal passage 24*a* of the throttle body 24 and the internal passage 25*a* of the intake manifold 25 to the engine E.

The resonator (silencer) 30 is provided at the air cleaner hose 22. The resonator 22 is a Helmholtz resonator and includes a volume portion 31 and a connecting pipe 32.

The volume portion 31 is configured to the form of a box. The volume portion 31 is located outside the intake pipe 20. The volume portion 31 includes a single volume chamber 31*a* therein. The volume chamber 31*a* acts as a resonance chamber.

The connecting pipe 32 connects the volume portion 31 and the air cleaner hose 22. The connecting pipe 32 includes a single connecting passage 32*a* connecting the volume chamber 31*a* of the volume portion 31 and the internal passage 22*a* of the air cleaner hose 22 therein. The connecting pipe 32 (the connecting passage 32*a*) has an axis P1 which extends up-down direction over an entirety of the connecting pipe 32. The axis P1 of the connecting pipe 32 extending in the up-down direction may extend linearly over the entirety of the connecting pipe 32 or may have at least one curved portion. As illustrated in FIG. 2, an opening 32*b* of the connecting passage 32*a* to the intake passage 20*a* (the intake passage 20*a* of the air cleaner hose 22) is located above a mid-portion of the intake passage 20*a* (the internal passage 22*a* of the air cleaner hose 22) in the up-down direction. In FIG. 2, "UP" shows an up direction. As illustrated in FIG. 1, the connecting pipe 32 has a large-diameter portion 32*e* at an intake pipe 20 (an air cleaner hose 22)-side end of the connecting pipe. An inner diameter and an outer diameter of the large-diameter portion 32*e* are larger in diameter than those of portions of the connecting pipe 32 other than the intake pipe 20 (an air cleaner hose 22)-side end of the connecting pipe. Since the intake pipe 32 has the large-diameter portion 32*e*, the intake passage 22*a*-side end of the connecting passage 32*a* of the connecting pipe 32 is larger in diameter than the portions of the connecting passage 32*a* of the connecting pipe 32 other than the intake passage 22*a*-side end of the connecting passage 32*a* of the connecting pipe 32.

The blowby gas recirculation pipe 40 is a pipe provided for returning (recirculating) blowby gas, which leaks through a clearance between a piston ring (not shown) and a cylinder wall (not shown) into a crankcase, to the intake passage 20*a* by a so-called PCV system (Positive Crankcase Ventilation System). The blowby gas recirculation pipe 40 includes an internal passage 40*a* therein. The blowby gas having flowed through the internal passage 40*a* of the blowby gas recirculation pipe 40 includes water (steam) and oil (oil mist) such as engine oil, etc., which has not been collected by an oil separator (not shown).

The blowby gas recirculation pipe 40 is connected to the connecting pipe 32 of the resonator 30 at an axial and midway portion of the connecting pipe. The blowby gas recirculation pipe 40 is connected to an intake pipe 20-side (an air cleaner hose 22-side) portion of the connecting pipe 32 of the resonator 30 when the connecting pipe 32 is sectioned into two portions in an axial direction of the connecting pipe 32. Preferably, the blowby gas recirculation pipe 40 is connected to a portion of the connecting pipe 32 of the resonator 30 closest to the intake pipe 20 (the air cleaner hose 22) when the connecting pipe 32 is sectioned into three portions in the axial direction of the connecting pipe 32.

An exit 40*b* of the internal passage 40*a* of the blowby gas recirculation pipe 40 is connected to the connecting passage 32*a* of the connecting pipe 30 of the resonator 30. The exit 40*b* of the internal passage 40*a* of the blowby gas recirculation pipe 40 is located above the opening 32*b* of the connecting passage 32*a* of the connecting pipe 32 of the resonator 30 to the intake passage 20*a* (the internal passage 22*a* of the air cleaner hose 22) and is located below a connecting portion 32*c* of the connecting passage 32*a* of the connecting pipe 32 of the resonator 30 to the volume chamber 31*a*. The exit 40*b* of the internal passage 40*a* of the blowby gas recirculation pipe 40 opposes an inner wall surface 32*d* of the connecting pipe 32 of the resonator 30.

Blowby gas flows in a rubber hose 41 connecting the engine E and the blowby gas recirculation pipe 40 and flows into the internal passage 40*a* of the blowby gas recirculation pipe 40. The blowby gas having flowed into the internal passage 40*a* flows through the internal passage 40*a* and flows into the connecting passage 32*a* of the connecting pipe 32, and then flows through the connecting passage 32*a* and flows into the internal passage 22*a* of the air cleaner hose 22.

Next, operations and technical advantages of certain embodiments of the present invention will be explained. In the embodiment of the present invention, since the blowby gas recirculation pipe 40 is connected to the connecting pipe 32 of the resonator 30 at the axially midway portion of the connecting pipe, and the exit 40*b* of the internal passage 40*a* of the blowby gas recirculation pipe 40 is connected to the connecting passage 32*a* of the connecting pipe 32 of the resonator 30, the following operations and technical advantages can be obtained: Oil (oil mist) and water (steam) having flowed through the blowby gas recirculation pipe 40 are more likely to enter the intake passage 20*a* of the intake pipe 20 than in a case where the blowby gas recirculation pipe 40 is connected to the volume portion 31 of the resonator 30. As a result, the oil and water having flowed through the blowby gas recirculation pipe 40 are prevented from staying stagnant in the volume chamber 31*a* of the resonator 30 without flowing into the intake passage 20*a* of the intake pipe 20. Further, an aperture provided at the intake pipe 20 is only one unlike a case where the blowby gas recirculation pipe 40 is connected directly to the intake pipe 20. As a result, a cost down can be obtained compared with a case where an aperture for the resonator 30 and an aperture for the blowby gas recirculation pipe 40 (two apertures) are provided at the intake pipe 20.

Since the connecting pipe 32 of the resonator 30 includes the axis P1 extending in an up-down direction over an entirety of the connecting pipe, the following operations and technical advantages can be obtained: No concave shape exists at the connecting passage 32*a* of the connecting pipe 32 of the resonator 30. As a result, the oil and water having flowed through the blowby gas recirculation pipe 40 are prevented from staying in the connecting passage 32*a* of the connecting pipe 32 unlike the case where a concave shape exists at the connecting passage 32*a* of the connecting pipe 32 of the resonator 30.

Since the exit 40*b* of the internal passage 40*a* of the blowby gas recirculation pipe 40 is located above the opening 32*b* of the connecting passage 32*a* of the connecting pipe 32 of the resonator 30 to the intake passage 20*a* and is located below the connecting portion 32*c* of the connecting passage 32*a* of the connecting pipe 32 of the resonator 30 to the volume chamber 31*a*, the following operations and technical advantages can be obtained: The oil and water having flowed through the blowby gas recirculation pipe 40 are likely to flow into the intake passage 20*a* of the intake pipe 20 and are unlikely to flow into the volume chamber 31*a* of the resonator 30. As a result, the oil and water having flowed through the blowby gas recirculation pipe 40 are prevented from staying stagnant in the volume chamber 31*a* of the resonator 30 without flowing into the intake passage 20*a* of the intake pipe 20.

Since the exit 40*b* of the internal passage 40*a* of the blowby gas recirculation pipe 40 opposes the inner wall surface 32*d* of the connecting pipe 32 of the resonator 30, the following operations and technical advantages can be obtained: The oil and water having flowed through the blowby gas recirculation pipe 40 collide with the inner wall surface 32*d* of the connecting pipe 32 of the resonator 30 and change to liquid drops. As a result, the oil and water having flowed through the blowby gas recirculation pipe 40 are prevented from remaining in the form of mist and flowing into the volume chamber 31*a* of the resonator 30.

Since the intake passage 20*a*-side end of the connecting passage 32*a* of the connecting pipe 32 of the resonator 30 has a larger diameter than portions of the connecting passage 32*a* of the connecting pipe 32 of the resonator 30 other than the intake passage 20*a*-side end of the connecting passage 32*a*, the following operations and technical advantages can be obtained: Even at a cold time such as winter, water (steam) in the connecting passage 32*a* of the connecting pipe 32 of the resonator 30 and/or water (steam) in the intake passage 20*a* of the intake pipe 20 are prevented from being frozen thereby blocking the opening 32*b* of the connecting passage 32*a* of the connecting pipe 32 of the resonator 30 to the intake passage 20*a*.

Since the blowby gas recirculation pipe 40 is connected to the intake pipe 20-side (an air cleaner hose 22-side) portion of the connecting pipe 32 of the resonator 30 when the connecting pipe 32 is sectioned into two portions in the axial direction of the connecting pipe 32, the following operations and technical advantages can be obtained: The oil and water having flowed through the blowby gas recirculation pipe 40 can be effectively caused to flow into the intake passage 20*a* of the intake pipe 20, unlike the case where the blowby gas recirculation pipe 40 is connected to the volume portion 31-side portion of the connecting pipe 32 of the resonator 30 when the connecting pipe 32 is sectioned into two portions in the axial direction of the connecting pipe 32.

Since the blowby gas recirculation pipe 40 is connected to the portion of the connecting pipe 32 of the resonator 30 closest to the intake pipe 20 (the air cleaner hose 22) when the connecting pipe 32 is sectioned into three portions in the axial direction of the connecting pipe 32, the following operations and technical advantages can be obtained: The oil and water having flowed through the blowby gas recirculation pipe 40 can be effectively caused to flow into the intake passage 20*a* of the intake pipe 20, unlike in the case where the blowby gas recirculation pipe 40 is connected to the portion of the connecting pipe 32 of the resonator 30 closest to the intake pipe 20 (the air cleaner hose 22) when the connecting pipe 32 is sectioned into three portions in the axial direction of the connecting pipe 32.

EXPLANATION OF REFERENCE NUMERALS

10 intake apparatus
20 intake pipe
20*a* intake passage
21 inlet
21*a* internal passage of the inlet
22 air cleaner hose
22*a* internal passage of the air cleaner hose
23 air cleaner
23*a* element
23*b* dusty side
23*b* clean side
24 throttle body
24*a* internal passage of the throttle body
24*b* throttle valve
25 intake manifold
25*a* internal passage of the intake manifold
30 resonator
31 volume portion
31*a* volume chamber
32 connecting pipe
32*a* connecting passage
32*b* opening of the connecting passage to the intake passage
32*c* connecting portion of the connecting passage to the volume chamber
32*d* inner wall surface of the connecting pipe
32*e* large-diameter portion
40 blowby gas recirculation pipe
40*a* internal passage
40*b* exit of the internal passage
E engine
P1 axis of the connecting pipe of the resonator

The invention claimed is:

1. An intake apparatus comprising:
an intake pipe for a vehicle;
a resonator; and
a blowby gas recirculation pipe, wherein
the intake pipe includes an intake passage therein,
the resonator includes a volume portion and a connecting pipe connecting the volume portion and the intake pipe, the volume portion including a volume chamber therein, the connecting pipe including a connecting passage therein and connecting the volume chamber and the intake passage,
the blowby gas recirculation pipe includes an internal passage therein,
the blowby gas recirculation pipe is connected to the connecting pipe at an axial and midway portion of the connecting pipe, and an exit of the internal passage is connected to the connecting passage, and
the blowby gas recirculation pipe is entirely disposed outside the volume portion.

2. The intake apparatus according to claim 1, wherein the connecting pipe includes an axis extending in an up-down direction over an entirety of the connecting pipe.

3. The intake apparatus according to claim 1, wherein the exit of the internal passage is located above an opening of the connecting passage to the intake passage and is located below a connecting portion of the connecting passage to the volume chamber.

4. The intake apparatus according claim 1, wherein the exit of the internal passage opposes an inner wall surface of the connecting pipe.

5. The intake apparatus according to claim 1, wherein an intake passage-side end of the connecting passage has a larger diameter than portions of the connecting passage other than the intake passage-side end.

* * * * *